US005906767A

United States Patent [19]

Karol et al.

[11] Patent Number: 5,906,767

[45] Date of Patent: May 25, 1999

[54] MAGNETORHEOLOGICAL FLUID

[75] Inventors: Thomas J. Karol, Norwalk, Conn.; Beth C. Munoz, Apex, N.C.; Anthony J. Margida, Scandia, Minn.

[73] Assignee: Lord Corporation, Cary, N.C.

[21] Appl. No.: 08/959,514

[22] Filed: Oct. 28, 1997

Related U.S. Application Data

[63] Continuation-in-part of application No. 08/664,035, Jun. 13, 1996, Pat. No. 5,683,615, and a continuation-in-part of application No. 08/664,075, Jun. 13, 1996, Pat. No. 5,705,085.

[51] Int. Cl.[6] ..... H01F 1/44

[52] U.S. Cl. ..... 252/62.52; 252/62.51 R; 252/62.54

[58] Field of Search ..... 252/62.52, 62.51 R, 252/62.54

[56] References Cited

U.S. PATENT DOCUMENTS

| | | | |
|---|---|---|---|
| 2,751,352 | 6/1956 | Bondi | 252/62.5 |
| 4,430,239 | 2/1984 | Wyman | 252/62.51 R |
| 4,626,370 | 12/1986 | Wakayama et al. | 252/62.51 |
| 4,938,886 | 7/1990 | Lindsten et al. | 252/62.51 R |
| 4,957,644 | 9/1990 | Price et al. | 252/62.52 |
| 4,992,190 | 2/1991 | Shtarkman | 252/62.52 |
| 5,147,573 | 9/1992 | Chagnon | 252/62.52 |
| 5,167,850 | 12/1992 | Shtarkman | 252/62.52 |
| 5,271,858 | 12/1993 | Clough et al. | 252/74 |
| 5,354,488 | 10/1994 | Shtarkman et al. | 252/62.56 |
| 5,382,373 | 1/1995 | Carlson et al. | 252/62.55 |
| 5,578,238 | 11/1996 | Weiss et al. | 252/62.52 |
| 5,599,474 | 2/1997 | Weiss et al. | 252/62.52 |
| 5,645,752 | 7/1997 | Weiss et al. | 252/62.54 |
| 5,665,684 | 9/1997 | Arai et al. | 508/365 |

FOREIGN PATENT DOCUMENTS

| | | | |
|---|---|---|---|
| 63-232402 | 9/1988 | Japan | 252/62.52 |

*Primary Examiner*—Melissa Bonner
*Attorney, Agent, or Firm*—Wayne W. Rupert

[57] ABSTRACT

A magnetorheological fluid that includes magnetic-responsive particles, a carrier fluid and a phosphorus additive. The magnetorheological fluid does not include an organomolybdenum, a thiophosphorus additive or a thiocarbamate additive.

21 Claims, No Drawings

MAGNETORHEOLOGICAL FLUID

This application is a continuation-in-part application of applications Ser. No. 08/664,035, filed Jun. 13, 1996 , now U.S. Pat. No. 5,683,615, and Ser. No. 08/664,075, also filed Jun. 13, 1996, now U.S. Pat. No. 5,705,085.

BACKGROUND AND SUMMARY OF THE INVENTION

This invention relates to fluids that exhibit substantial increases in flow resistance when exposed to magnetic fields.

Fluid compositions that undergo a change in apparent viscosity in the presence of a magnetic field are commonly referred to as Bingham magnetic fluids or magnetorheological fluids. Magnetorheological fluids typically include magnetic-responsive particles dispersed or suspended in a carrier fluid. In the presence of a magnetic field, the magnetic-responsive particles become polarized and are thereby organized into chains of particles or particle fibrils within the carrier fluid. The chains of particles act to increase the apparent viscosity or flow resistance of the overall materials resulting in the development of a solid mass having a yield stress that must be exceeded to induce onset of flow of the magnetorheological fluid. The force required to exceed the yield stress is referred to as the "yield strength". In the absence of a magnetic field, the particles return to an unorganized or free state and the apparent viscosity or flow resistance of the overall materials is correspondingly reduced. Such absence of a magnetic field is referred to herein as the "off-state".

Magnetorheological fluids are useful in devices or systems for controlling vibration and/or noise. For example, magnetorheological fluids are useful in providing controllable forces acting upon a piston in linear devices such as dampers, mounts and similar devices. Magnetorheological fluids are also useful for providing controllable torque acting upon a rotor in rotary devices. Possible linear or rotary devices could be clutches, brakes, valves, dampers, mounts and similar devices. In these applications magnetorheological fluid can be subjected to shear forces as high as 70 kPa, often significantly higher, and shear rates in the order of 20,000 to 50,000 $sec^{-1}$ causing extreme wear on the magnetic-responsive particles. As a result, the magnetorheological fluid thickens substantially over time leading to increasing off-state viscosity. The increasing off-state viscosity leads to an increase in off-state force experienced by the piston or rotor. This increase in off-state force hampers the freedom of movement of the piston or rotor at off-state conditions. In addition, it is desirable to maximize the ratio of on-state force to off-state force in order to maximize the controllability offered by the device. Since the on-state force is dependent upon the magnitude of the applied magnetic field, the on-state force should remain constant at any given applied magnetic field. If the off-state force increases over time because the off-state viscosity is increasing but the on-state force remains constant, the on-state/off-state ratio will decrease. This on-state/off-state ratio decrease results in undesirable minimization of the controllability offered by the device. A more durable magnetorheological fluid that does not thicken over an extended period of time, preferably over the life of the device that includes the fluid, would be very useful.

Magnetorheological fluids are described, for example, in U.S. Pat. Nos. 5,382,373, 5,578,238, 5,599,474 and 5,645,752. These patents mention that phosphate esters, in general, can be used as surfactants in magnetorheological fluids. U.S. Pat. No. 5,645,752 describes a magnetorheological fluid example formulation that includes a polyoxyalkylated alkylaryl phosphate ester.

U.S. Pat. No. 5,271,858 relates to an electrorheological fluid that includes esters and amides of an acid of phosphorus. U.S. Pat. No. 2,751,352 mentions that a magnetic fluid could include antioxidants or antiwear agents such as organic phosphorus compounds with dilorol phosphate, dilauryl phosphite, tributyl phosphate and tricresyl phosphate being listed. U.S. Pat. No. 5,147,573 relates to a magnetic colloid or ferrofluid that includes a surfactant having the general structure R"—R'—R— YH. Phosphate and thiol are mentioned as possible groups for YH and a secondary amine is mentioned as a possibility for R'.

SUMMARY OF THE INVENTION

It has been discovered that a useful magnetorheological fluid can be formulated with a phosphorus additive, wherein the fluid does not require an organomolybdenum as described in U.S. Pat. No. 5,705,085 or a thiophosphorus additive or thiocarbamate as described in U.S. Pat. No. 5,683,615.

The magnetorheological fluid includes magnetic-responsive particles, a carrier fluid and at least one phosphorus additive, wherein the fluid does not include an organomolybdenum, a thiophosphorus or a thiocarbamate and the phosphorus additive has a structure represented by formula A:

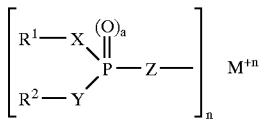

wherein $R^1$ and $R^2$ are each independently hydrogen, an amino group, or an alkyl group having 1 to 22 carbon atoms; X, Y and Z are each independently —$CH_2$—, a nitrogen heteroatom or an oxygen heteroatom, provided that at least one of X, Y or Z is an oxygen heteroatom; a is 0 or 1; and n is the valence of M; provided that if X, Y and Z are each an oxygen heteroatom, M is a salt moiety formed from an amine of the formula B:

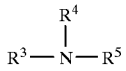

wherein $R^3$, $R^4$ and $R^5$ are each independently hydrogen or aliphatic groups having 1 to 18 carbon atoms; if at least one of X, Y or Z is not an oxygen heteroatom, M is selected from the group consisting of a metallic ion, a non-metallic moiety and a divalent moiety; provided that if Z is —$CH_2$—, M is a divalent moiety and if Z is a nitrogen heteroatom, M is not an amine of formula B.

The magnetorheological fluid of the invention exhibits superior durability because of a substantial decrease in the thickening of the fluid over a period of use.

DETAILED DESCRIPTION OF THE PREFERRED EMBODIMENTS

The phosphorus additive of formula A can be a phosphonate, phosphonite, phosphate, phosphinate, phosphinite, phosphite or the corresponding amide or imide derivatives.

$R^1$, $R^2$, $R^3$, $R^4$ and $R^5$ may be straight chain or branched chain alkyl groups. Examples of such groups include methyl, ethyl, propyl, isopropyl, tert-butyl, pentyl, dodecyl, decyl, hexadecyl, nonyl, octadecyl, 2-methyl dodecyl, 2-ethyl hexyl, 2-methyl pentyl, 2-ethyl octyl, 2-methyl octyl and 2-methyl hexyl. Illustrative amino groups for $R^1$ and $R^2$ include butylamine, nonylamine, hexadecylamine and decylamine and the amine shown in formula B above.

If at least one of X, Y or Z is not an oxygen heteroatom, M can be a metal ion such as molybdenum, tin, antimony, lead, bismuth, nickel, iron, zinc, silver, cadmium or lead or the carbides, oxides, sulfides or oxysulfides thereof. M can also be a non-metallic moiety such as hydrogen, a sulfur-containing group, alkyl, alkylaryl, arylalkyl, hydroxyalkyl, an oxy-containing group, amido or an amine. In general, any alkyl group should be suitable, but alkyls having from 2 to 20, preferably 3 to 16, carbon atoms are preferred. The alkyls could be straight chain or branched. Illustrative alkyl groups include methyl, ethyl, propyl, isopropyl, tert-butyl, pentyl, 2-ethylhexyl, dodecyl, decyl, hexadecyl and octadecyl. In general, any aryl groups should be suitable. Illustrative aryl groups include phenyl, benzylidene, benzoyl and naphthyl. In general, any amido-containing groups should be suitable. Illustrative amido groups include butynoamido, decynoamido, pentylamido and hexamido. In general, any amino groups should be suitable. Illustrative amino groups include butylamine, nonylamine, hexadecylamine and decylamine and the amine shown in formula B above. In general, any alkylaryl or arylalkyl groups should be suitable. Illustrative alkylaryl or arylalkyls include benzyl, phenylethyl, phenylpropyl, and alkyl-substituted phenyl alcohol. In general, any oxy-containing groups should be suitable, but alkoxy groups having from 2 to 20, preferably 3 to 12, carbon atoms are preferred. Illustrative alkoxy groups include methoxy, ethoxy, propoxy, butoxy and heptoxy. It should be recognized that if M is a metallic ion or a non-metallic moiety , Z cannot be —$CH_2$—.

M also can be a divalent group that links together two or more phosphorus-containing units to form a dimer, oligomer or polymer. For example, the phosphorus additive may have the following formula:

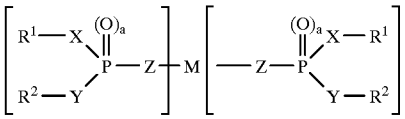

Possible divalent groups include alkylene. In general, any alkylene groups should be suitable, but those having from 1 to 16, preferably 1 to 8, carbon atoms are preferred. Illustrative alkylene groups include methylene and propylene. It should be recognized that if Z is —$CH_2$—, M must be a divalent moiety such as an alkylene group.

A particularly preferred alkyl amine phosphate is a $C_{12-14}$-alkylamine salt of tert-octylphosphates commercially available from R.T. Vanderbilt Inc. wherein $R^1$ and $R^2$ are tert-octyl, subscript a is 1 and $R^3$, $R^4$ and $R^5$ are $C_{12-14}$ alkyls.

The phosphorus component that is added to the magnetorheological fluid preferably is soluble in the carrier fluid and does not contain any particles above molecular size.

The phosphorus additive can be present in an amount of 0.1 to 15, preferably 0.25 to 10, volume percent, based on the total volume of the magnetorheological fluid.

Other phosphates can be included in the magnetorheological fluid in addition to the phosphorus additive of formula A. Examples of such additional or secondary phosphates include tricresyl phosphate, trixylenyl phosphate, dilauryl phosphate, octadecyl phosphate, hexadecyl phosphate, dodecyl phosphate and didodecyl phosphate.

The magnetic-responsive particle component of the magnetorheological material of the invention can be comprised of essentially any solid which is known to exhibit magnetorheological activity. Typical magnetic-responsive particle components useful in the present invention are comprised of, for example, paramagnetic, superparamagnetic or ferromagnetic compounds. Superparamagnetic compounds are especially preferred. Specific examples of magnetic-responsive particle components include particles comprised of materials such as iron, iron oxide, iron nitride, iron carbide, carbonyl iron, chromium dioxide, low carbon steel, silicon steel, nickel, cobalt, and mixtures thereof. The iron oxide includes all known pure iron oxides, such as $Fe_2O_3$ and $Fe_3O_4$, as well as those containing small amounts of other elements, such as manganese, zinc or barium. Specific examples of iron oxide include ferrites and magnetites. In addition, the magnetic-responsive particle component can be comprised of any of the known alloys of iron, such as those containing aluminum, silicon, cobalt, nickel, vanadium, molybdenum, chromium, tungsten, manganese and/or copper.

The magnetic-responsive particle component can also be comprised of the specific iron-cobalt and iron-nickel alloys described in U.S. Pat. No. 5,382,373. The iron-cobalt alloys useful in the invention have an iron:cobalt ratio ranging from about 30:70 to 95:5, preferably ranging from about 50:50 to 85:15, while the iron-nickel alloys have an iron-:nickel ratio ranging from about 90:10 to 99:1, preferably ranging from about 94:6 to 97:3. The iron alloys may contain a small amount of other elements, such as vanadium, chromium, etc., in order to improve the ductility and mechanical properties of the alloys. These other elements are typically present in an amount that is less than about 3.0% by weight. Due to their ability to generate somewhat higher yield stresses, the iron-cobalt alloys are presently preferred over the iron-nickel alloys for utilization as the particle component in a magnetorheological material. Examples of the preferred iron-cobalt alloys can be commercially obtained under the tradenames HYPERCO (Carpenter Technology), HYPERM (F. Krupp Widiafabrik), SUPERMENDUR (Arnold Eng.) and 2V-PERMENDUR (Western Electric).

The magnetic-responsive particle component of the invention is typically in the form of a metal powder which can be prepared by processes well known to those skilled in the art. Typical methods for the preparation of metal powders include the reduction of metal oxides, grinding or attrition, electrolytic deposition, metal carbonyl decomposition, rapid solidification, or smelt processing. Various metal powders that are commercially available include straight iron powders, reduced iron powders, insulated reduced iron powders, cobalt powders, and various alloy powders such as [48%]Fe/[50%]Co/[2%]V powder available from UltraFine Powder Technologies.

The preferred magnetic-responsive particles are those that contain a majority amount of iron in some form. Carbonyl iron powders that are high purity iron particles made by the thermal decomposition of iron pentacarbonyl are particularly preferred. Carbonyl iron of the preferred form is commercially available from ISP Technologies, GAF Corporation and BASF Corporation.

The particle size should be selected so that it exhibits multi-domain characteristics when subjected to a magnetic field. The magnetic-responsive particles should have an average particle size distribution of at least about 0.1 μm, preferably at least about 1 μm. The average particle size distribution should range from about 0.1 to about 500 μm, with from about 1 to about 500 μm being preferred, about 1 to about 250 μm being particularly preferred, and from about 1 to about 100 μm being especially preferred.

The amount of magnetic-responsive particles in the magnetorheological fluid depends upon the desired magnetic activity and viscosity of the fluid, but should be from about 5 to about 50, preferably from about 15 to 40, percent by volume based on the total volume of the magnetorheological fluid.

The carrier component is a fluid that forms the continuous phase of the magnetorheological fluid. Suitable carrier fluids may be found to exist in any of the classes of oils or liquids known to be carrier fluids for magnetorheological fluids such as natural fatty oils, mineral oils, polyphenylethers, polyesters (such as perfluorinated polyesters, dibasic acid esters and neopentylpolyol esters), phosphate esters (exclusive of the phosphorus additive), synthetic cycloparaffin oils and synthetic paraffin oils, unsaturated hydrocarbon oils, monobasic acid esters, glycol esters and ethers (such as polyalkylene glycol), synthetic hydrocarbon oils, perfluorinated polyethers and halogenated hydrocarbons, as well as mixtures and derivatives thereof. The carrier component may be a mixture of any of these classes of fluids. The preferred carrier component is non-volatile, non-polar and does not include any significant amount of water. The carrier component (and thus the magnetorheological fluid) preferably should not include any volatile solvents commonly used in lacquers or compositions that are coated onto a surface and then dried such as toluene, cyclohexanone, methyl ethyl ketone, methyl isobutyl ketone and acetone. Descriptions of suitable carrier fluids can be found, for example, in U.S. Pat. No. 2,751,352 and U.S. Pat. No. 5,382,373, both hereby incorporated by reference. Hydrocarbons, such as mineral oils, paraffins, cycloparaffins (also known as naphthenic oils) and synthetic hydrocarbons are the preferred classes of carrier fluids. The synthetic hydrocarbon oils include those oils derived from oligomerization of olefins such as polybutenes and oils derived from high molecular weight alpha olefins of from 8 to 20 carbon atoms by acid catalyzed dimerization and by oligomerization using trialuminum alkyls as catalysts. Poly-α-olefin is a particularly preferred carrier fluid. Carrier fluids appropriate to the present invention may be prepared by methods well known in the art and many are commercially available.

The carrier fluid of the present invention is typically utilized in an amount ranging from about 50 to 95, preferably from about 60 to 85, percent by volume of the total magnetorheological fluid.

The magnetorheological fluid can optionally include other additives such as a thixotropic agent, a carboxylate soap, an antioxidant, a lubricant, a viscosity modifier, a sulfur-containing compound or mixture thereof. If present, the amount of these optional additives typically ranges from about 0.25 to about 10, preferably about 0.5 to about 7.5, volume percent based on the total volume of the magnetorheological fluid.

Useful thixotropic agents are described, for example, in U.S. Pat. No. 5,645,752, incorporated herein by reference. Such thixotropic agents include polymer-modified metal oxides. The polymer-modified metal oxide can be prepared by reacting a metal oxide powder with a polymeric compound that is compatible with the carrier fluid and capable of shielding substantially all of the hydrogen-bonding sites or groups on the surface of the metal oxide from any interaction with other molecules. Illustrative metal oxide powders include precipitated silica gel, fumed or pyrogenic silica, silica gel, titanium dioxide, and iron oxides such as ferrites or magnetites. Examples of polymeric compounds useful in forming the polymer-modified metal oxides include siloxane oligomers, mineral oils and paraffin oils, with siloxane oligomers being preferred. The metal oxide powder may be surface-treated with the polymeric compound through techniques well known to those skilled in the art of surface chemistry. A polymer-modified metal oxide, in the form of fumed silica treated with a siloxane oligomer, can be commercially obtained under the trade names AEROSIL R-202 and CABOSIL TS-720 from DeGussa Corporation and Cabot Corporation, respectively.

Examples of the carboxylate soap include lithium stearate, calcium stearate, aluminum stearate, ferrous oleate, ferrous stearate, zinc stearate, sodium stearate, strontium stearate and mixtures thereof.

Examples of sulfur-containing compounds include thioesters such as tetrakis thioglycolate, tetrakis(3-mercaptopropionyl) pentaerithritol, ethylene glycoldimercaptoacetate, 1,2,6-hexanetriol trithioglycolate, trimethylol ethane tri(3-mercaptopropionate), glycoldimercaptopropionate, bisthioglycolate, trimethylolethane trithioglycolate, trimethylolpropane tris(3-mercaptopropionate) and similar compounds and thiols such as 1-dodecylthiol, 1-decanethiol, 1-methyl-1-decanethiol, 2-methyl-2-decanethiol, 1-hexadecylthiol, 2-propyl-2-decanethiol, 1-butylthiol, 2-hexadecylthiol and similar compounds.

The viscosity of the magnetorheological fluid is dependent upon the specific use of the magnetorheological fluid. In the instance of a magnetorheological fluid that is used with a damper the carrier fluid should have a viscosity of 6 to 500, preferably 15 to 395, Pa-sec measured at 40° C. in the off-state.

The magnetorheological fluid can be used in any controllable device such as dampers, mounts, clutches, brakes, valves and similar devices. These magnetorheological devices include a housing or chamber that contains the magnetorheological fluid. Such devices are known and are described, for example, in U. S. Pat. Nos. 5,277,281; 5,284,330; 5,398,917; 5,492,312; 5,176,368; 5,257,681; 5,353,839; and 5,460,585, all incorporated herein by reference, and PCT published patent application WO 96/07836. The fluid is particularly suitable for use in devices that require exceptional durability such as dampers. As used herein, "damper" means an apparatus for damping motion between two relatively movable members. Dampers include, but are not limited to, shock absorbers such as automotive shock absorbers. The magnetorheological dampers described in U.S. Pat. No. 5,277,281 and U.S. Pat. No. 5,284,330, both incorporated herein by reference, are illustrative of magnetorheological dampers that could use the magnetorheological fluid.

Examples of the magnetorheological fluid were prepared as follows:

EXAMPLE 1

28.8 g of a poly-α-olefin oil (available from Albemarle Corporation under the tradename DURASYN 166), 19.4 g of a poly-α-olefin oil (available from Albemarle Corporation under the tradename DURASYN 170) and 4.48 g of an alkyl amine phosphate (available from R.T. Vanderbilt Inc.) were added to a large stainless steel beaker. These materials were mixed at 500 rpm and heated to 85° C. 298.7 g of reduced grade carbonyl iron (available from International Specialty Products under the tradename R-2430) were added to the resulting homogeneous mixture while mixing at 1500 rpm. The mixing is continued for one hour at 2000 rpm then the mixture was allowed to cool to room temperature. The mixture was subsequently mixed at a high speed dispersion of 4800 rpm for 7 minutes while cooling with an ice bath to maintain a temperature near ambient.

EXAMPLE 2

57.1 g of DURASYN 170 poly-α-olefin oil and 5.9 g of mono octadecyl dihydrogen phosphonate were added to a large stainless steel beaker. These materials were mixed at 500 rpm and heated to 85° C. To this homogeneous mixture, 196.5 g of reduced grade carbonyl iron (R-2430) was added while mixing at 1500 rpm. The mixing was continued for one hour at 2000 rpm then the mixture was allowed to cool to room temperature. The mixture was subsequently mixed at a high speed dispersion of 4800 rpm for 10 minutes while cooling with an ice bath to maintain a temperature near ambient.

What is claimed is:

1. A magnetorheological fluid comprising magnetic-responsive particles, a carrier fluid and at least one phosphorus additive, wherein the magnetorheological fluid does not include an organomolybdenum, a thiophosphorus additive or a thiocarbamate additive and the phosphorus additive has a structure represented by formula A:

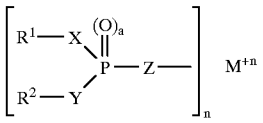

wherein $R^1$ and $R^2$ are each independently hydrogen, an amino group or an alkyl group having 1 to 22 carbon atoms; X, Y and Z are each independently —$CH_2$—, a nitrogen heteroatom or an oxygen heteroatom, provided that at least one of X, Y or Z is an oxygen heteroatom; a is 0 or 1; and n is the valence of M; provided that if X, Y and Z are each an oxygen heteroatom, M is a salt moiety formed from an amine of the formula B:

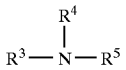

wherein $R^3$, $R^4$ and $R^5$ are each independently hydrogen or aliphatic groups having 1 to 18 carbon atoms and, if at least one of X, Y or Z is not an oxygen heteroatom, M is selected from the group consisting of a metallic ion, a non-metallic moiety and a divalent moiety, provided that if Z is —$CH_2$— then M is a divalent moiety and if Z is a nitrogen heteroatom then M is not an amine of formula B.

2. A magnetorheological fluid according to claim 1, wherein X, Y and Z are each an oxygen heteroatom and M is the amine moiety of formula B.

3. A magnetorheological fluid according to claim 1, wherein the phosphorus additive is present in an amount of 0.1 to 15 volume percent, based on the total volume of the magnetorheological fluid.

4. A magnetorheological fluid according to claim 1, wherein the magnetic-responsive particles have an average particle size of 0.1 to 500 μm.

5. A magnetorheological fluid according to claim 1, wherein the magnetic-responsive particles have an average particle size of at least 1 μm.

6. A magnetorheological fluid according to claim 1, wherein the carrier fluid comprises at least one fluid selected from the group consisting of natural fatty oil, mineral oil, polyphenylether, phosphate ester, polyester, cycloparaffin oil, paraffin oil, unsaturated hydrocarbon oil, synthetic hydrocarbon oil, monobasic acid ester, glycol ester, glycol ether, synthetic hydrocarbon, perfluorinated polyether and halogenated hydrocarbon.

7. A magnetorheological fluid according to claim 6, wherein the carrier fluid is selected from the group consisting of mineral oil, paraffin oil, cycloparaffin oil and synthetic hydrocarbon.

8. A magnetorheological fluid according to claim 7, wherein the carrier fluid comprises a synthetic hydrocarbon derived from polyalphaolefin.

9. A magnetorheological fluid according to claim 6, wherein the carrier fluid comprises neopentylpolyol ester.

10. A magnetorheological fluid according to claim 1, wherein the magnetic-responsive particles have an average particle size of 0.1 to 500 μm and the carrier fluid is selected from the group consisting of mineral oil, paraffin, cycloparaffin, and synthetic hydrocarbon.

11. A magnetorheological fluid according to claim 1, further comprising at least one second phosphate.

12. A magnetorheological fluid according to claim 11 wherein the second phosphate is selected from the group consisting of tricresyl phosphate, trixylenyl phosphate, dilauryl phosphate, octadecyl phosphate, hexadecyl phosphate, dodecyl phosphate and didodecyl phosphate.

13. A magnetorheological fluid according to claim 1, further comprising a sulfur-containing compound.

14. A magnetorheological fluid according to claim 1, further comprising at least one carboxylate soap.

15. A magnetorheological fluid according to claim 14, wherein the carboxylate soap is selected from the group consisting of lithium stearate, calcium stearate, aluminum stearate, ferrous oleate, ferrous stearate, zinc stearate, sodium stearate and strontium stearate.

16. A magnetorheological fluid according to claim 1, further comprising a polymer-modified metal oxide.

17. A magnetorheological fluid according to claim 1, further comprising a carboxylate soap and a polymer-modified metal oxide.

18. A magnetorheological fluid according to claim 2, wherein the phosphorus additive comprises a $C_{12-14}$-alkylamine salt of tert-octylphosphate.

19. A magnetorheological fluid according to claim 2, wherein the phosphorus additive is present in an amount of 0.1 to 10 volume percent, based on the total volume of the magnetorheological fluid, the magnetic-responsive particles have an average particle size of at least 1 μm and the carrier fluid comprises at least one fluid selected from the group consisting of natural fatty oil, mineral oil, polyphenylether, phosphate ester, polyester, cycloparaffin oil, paraffin oil, unsaturated hydrocarbon oil, synthetic hydrocarbon oil, monobasic acid ester, glycol ester, glycol ether, synthetic hydrocarbon, perfluorinated polyether and halogenated hydrocarbon.

20. A magnetorheological fluid according to claim 2, further comprising at least one carboxylate soap.

21. A magnetorheological fluid according to claim 1 wherein X and Y are each an oxygen heteroatom and Z is —$CH_2$—.

* * * * *